US006095464A

United States Patent [19]

du Rées

[11] Patent Number: 6,095,464

[45] Date of Patent: Aug. 1, 2000

[54] LEG EXTENSION STRUCTURE FOR A CHAIR

[75] Inventor: Stephan du Rées, Stockholm, Sweden

[73] Assignee: Mercado Medic AB, Lidingö, Sweden

[21] Appl. No.: 09/155,911

[22] PCT Filed: Feb. 12, 1997

[86] PCT No.: PCT/SE97/00214

§ 371 Date: Dec. 14, 1998

§ 102(e) Date: Dec. 14, 1998

[87] PCT Pub. No.: WO97/37565

PCT Pub. Date: Oct. 16, 1997

[30] Foreign Application Priority Data

Apr. 11, 1996 [SE] Sweden ..... 9601374

[51] Int. Cl.[7] ..... A47B 91/00

[52] U.S. Cl. ..... 248/188.7; 248/188.8

[58] Field of Search ..... 248/188.7, 188, 248/188.1, 188.8, 129, 165; 16/30, 32, 33

[56] References Cited

U.S. PATENT DOCUMENTS

| | | | |
|---|---|---|---|
| 1,330,376 | 2/1920 | House | 248/129 |
| 2,455,048 | 11/1948 | Du Brie | 16/30 X |
| 3,452,380 | 7/1969 | Walther | 16/30 X |
| 4,053,129 | 10/1977 | Graff | 248/188.7 |
| 4,128,222 | 12/1978 | Wiczer | 248/188 |
| 4,187,578 | 2/1980 | Little | 248/188.7 X |
| 4,412,667 | 11/1983 | Doerner | 248/188.7 |
| 4,930,842 | 6/1990 | Wilkinson et al. | 297/466 |

FOREIGN PATENT DOCUMENTS

| | | | |
|---|---|---|---|
| 857145 | 12/1970 | Canada | 16/30 |

*Primary Examiner*—Ramon O. Ramirez
*Assistant Examiner*—David Heisey
*Attorney, Agent, or Firm*—Ostrolenk, Faber, Gerb & Soffen, LLP

[57] ABSTRACT

An arrangement for a chair having a central pillar (4) supporting a seat provided with a back support, coacts with a base structure (1) which includes at least three feet (2) constructed from supporting members (5) integral with, and projecting transversely from, a central sleeve (3) accommodating the pillar. Free end portions (6) of the members (5) project a given distance from the sleeve (3) and have fastening elements (7) for wheels or other floor-contacting elements (10) bearing against a floor or other substructure. At least one extension piece (8) is removably mountable on the fastening elements (7) of the supporting members (5) in place of the wheels or other floor-contacting elements (10) which are mounted on the fastening means (7) in a standard chair construction. This construction achieves greater spread of the floor contacting elements (10) and mitigation of the risk of tipping of the chair when it is provided with extra equipment, such as a neck rest.

6 Claims, 2 Drawing Sheets

LEG EXTENSION STRUCTURE FOR A CHAIR

BACKGROUND OF THE INVENTION

The present invention relates to an arrangement for the structure of a chair having a central pillar carrying a seat provided with a back support, and coacting with a base structure including at least three feet consisting of supporting members integral with, and projecting transversely from, a central sleeve accommodating the pillar, the free end portions of the members projecting a given distance from the sleeve and having fastening elements for wheels or floor-contacting member by which the chair contacts a floor or other substructure.

There is usually a problem with this kind of chair, particularly when the back support is provided with a neck rest, in which there is a greatly increased risk of the chair tipping over if the standard base structure is used.

SUMMARY OF THE INVENTION

The object of the present invention is to achieve an extension of the feet included in the base of the chair, such that the tipping hazard and possible injury to the user as a result of tipping are, to a large extent, eliminated. The distinguishing features of the invention are disclosed in the accompanying claims.

As a result of the invention, there has now been achieved an arrangement in the base structure of a chair which excellently fulfils the above objectives, while being both simple and cheap to manufacture. With the aid of the inventive arrangement, which takes the form of an extension piece for each foot, the wheels or other floor-contacting means which may have been originally fitted on the feet, may be transferred to the extension pieces. These may be already fitted on the extension pieces upon delivery, if the chair has a back support provided with a neck rest, and if the latter is removed the extension pieces may also be removed, thus returning the chair to its standard construction without the enhanced base structure provided by the present invention. This is possible, since the inventive extension piece is fixed to the respective chair foot without any damage to the foot.

BRIEF DESCRIPTION OF THE DRAWINGS

The invention will now be described in more detail with the aid of a preferred embodiment example and with reference to the accompanying drawings, in which.

DETAILED DESCRIPTION OF THE PREFERRED EMBODIMENT

Figure 1:
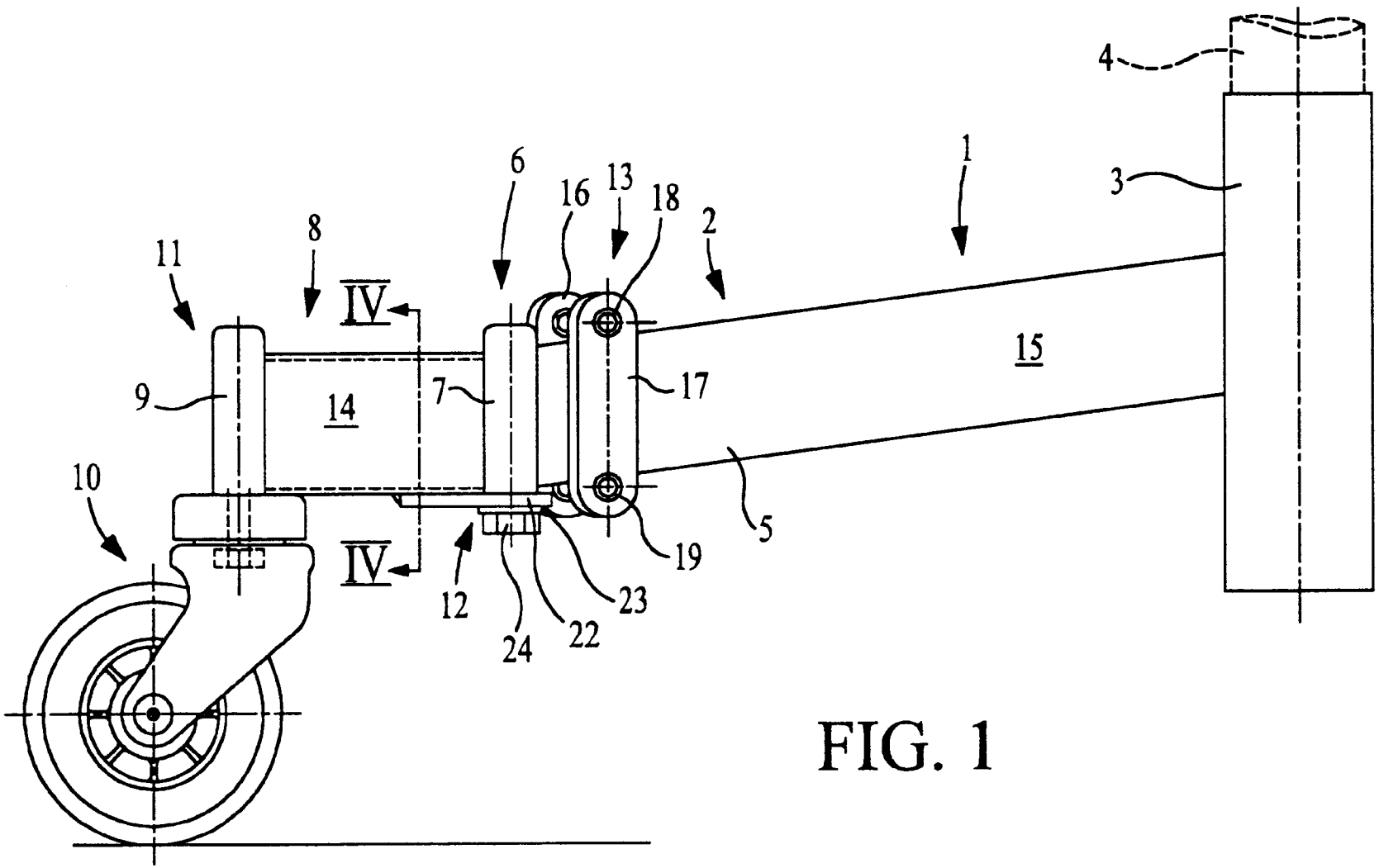
FIG. 1 is a side view of a foot in the base structure of a chair in accordance with the present invention, the foot being provided with a castor wheel for bearing against the floor.

As will be seen from the figures, particularly FIG. 1, the base structure 1 of a chair includes a foot 2, of which there are at least three. Each foot 2 includes a supporting member 5 fixed to and transverse to the longitudinal direction of a central sleeve 3 accommodating a pillar 4, for supporting an unillustrated chair seat. The members 5 project a given distance from the sleeve 3, and at their free ends 6 there are fastening element 7 for floor-contacting means, in this case castor wheels 10. In accordance with the invention, at least one, and preferably two, extension pieces 8 are fitted on feet 2 when the chair has been provided with a neck rest. The illustrated extension piece 8 is accordingly removably attachable to fastening element 7 of the member 5 in place of the wheels or floor-contacting means 10 which are normally attached thereto in the standard chair construction of the prior art. This structure thus achieves a greater spread of the floor-contacting means 10, which results in greater stability for the chair when it has been provided with an accessory such as a neck rest. In the illustrated example, the extension piece 8 has at its outer, free end 11 a fastening element 9 which is substantially the same as the fastening element 7. Consequently, the same wheel 10 can be mounted on the extension piece 8 in the same manner in which it is mounted on the fastening element 7 on the supporting member 5 in the standard chair construction of the prior art.

The inventive extension piece 8 has an angularly bent fastening plate 20 provided at its removably attachable portion 12 to attach the extension piece 8 to the free end portion 6 of the supporting member 5. With the aid of the fastening plate 20, when the plate is made integral with the clamping plate 16 in a bolted joint 13, the extension piece 8 may be fixably clamped at the free end portion 6 of the supporting member 5, and may also have an angular deviation in relation to the longitudinal direction of the supporting member 5, this deviation being preferably between 30° and 45°. By this deviation, further stability of the chair may be obtained.

Figures 2, 3, 4:
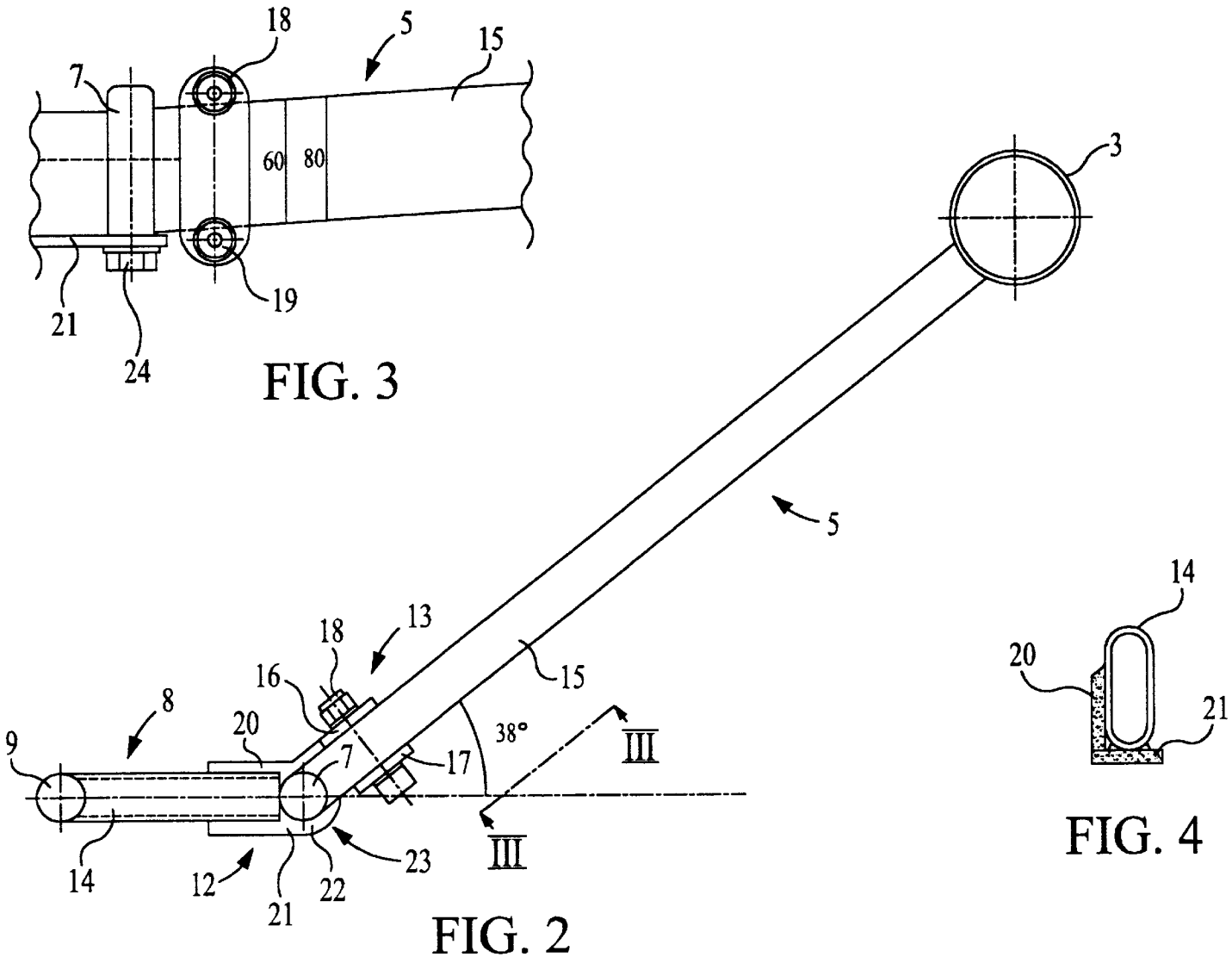
FIG. 2 is a view from above of the foot illustrated in FIG. 1.
FIG. 3 is a partial side view along the line III—III in FIG. 2.
FIG. 4 is a cross-section through the extension piece along the line IV—IV in FIG. 1.

In the preferred embodiment example, the extension piece 8 comprises a tubular section 14, corresponding in cross-section to the tubular section 15 forming the supporting member 5. In addition, the tubular section 14 has a length in the illustrated embodiment example that substantially corresponds to ⅓–⅕ of the tubular section 15. The bolted joint 13, used for attaching the extension piece to the foot 2 of the base structure 1, comprises two opposing clamping plates 16 and 17 which are intended to be placed on either side of the tubular section 15 and clamped together with the aid of bolts 18, 19 and associated nuts and washers. To make the attachment of the extension piece 8 to the foot 2 as stable as possible, plate 20 is also provided with a reinforcing plate 21 fixed under and at right angles thereto (see FIG. 4). This plate 21 projects out a short distance from the attachment end of the tubular section 14, and has a hole 23 in the projecting portion 22. Through this hole a bolt 24 is inserted to fix the plate 21 in the fastening element 7 of the supporting member 5.

What is claimed is:

1. An arrangement for a chair having a seat with a back support, comprising: a vertical support on which the seat is supported;

at least three leg members each projecting in a direction substantially transverse to the longitudinal direction of the vertical support and having a free end portion positioned furthest away from the vertical support;

a first fastening element provided on the free end portion of a corresponding one of the at least three leg members, the first fastening element capable of attaching a floor contacting member to the corresponding leg member;

an extension piece removably mountable in the first fastening element, the extension piece having an attachment end portion which is removably mounted in the first fastening element and an outer end portion which extends away from the corresponding leg member to which the extension piece is attached via the first fastening element; and a second fastening element provided on the outer end portion of the extension piece for attaching a floor contacting member, the second fastening element being structurally identical to the first fastening element to the extent that a floor contacting member can be interchangeably mounted in the first fastening element and the second fastening element.

2. The arrangement according to claim 1, further comprising an angularly bent fastening plate integrally formed with a bolted joint for clamping the attachment end portion of the extension piece to the free end portion of the corresponding leg member, wherein the angularly bent fastening plate holds the extension piece at an angular deviation relative to the corresponding leg member.

3. The arrangement according to claim 2, wherein the angularly bent fastening plate holds the extension piece at an angular deviation relative to the corresponding leg member in a range of from approximately 30° to approximately 45°.

4. The arrangement according to claim 2, wherein the bolted joint comprises two opposing plates for being placed on opposing sides of the respective leg member, and further comprises bolts and associated nuts for clamping the two opposing plates to the respective leg member.

5. The arrangement according to claim 2, further comprising a reinforcing plate fixed to and at a right angle to the angularly bent fastening plate, the reinforcing plate extending from the free end portion of the respective leg member and including a hole through which a bolt can be inserted for fixing the reinforcing plate to the first fastening element on the corresponding leg member.

6. The arrangement according to claim 1, wherein extension piece has a cross-section corresponding to the cross-section of the associated leg member to which the extension piece is attached, and wherein the extension piece has a length corresponding to a range of approximately ⅓ to ⅕ the length of the associated leg member.

* * * * *